US007909454B2

(12) United States Patent
Koto et al.

(10) Patent No.: US 7,909,454 B2
(45) Date of Patent: Mar. 22, 2011

(54) INKJET PRINTING PRESS

(75) Inventors: Haruhiko Koto, Koganei (JP); Masaru Nakano, Sanda (JP); Hiroyuki Santo, Sanda (JP); Osamu Satake, Sanda (JP); Makoto Miyaji, Osaka (JP)

(73) Assignee: Haruhiko Koto, Tokyo (JP)

( * ) Notice: Subject to any disclaimer, the term of this patent is extended or adjusted under 35 U.S.C. 154(b) by 1055 days.

(21) Appl. No.: 11/661,635

(22) PCT Filed: Sep. 21, 2004

(86) PCT No.: PCT/JP2004/013751

§ 371 (c)(1),
(2), (4) Date: Mar. 1, 2007

(87) PCT Pub. No.: WO2006/025119

PCT Pub. Date: Mar. 9, 2006

(65) Prior Publication Data

US 2008/0098910 A1 May 1, 2008

(30) Foreign Application Priority Data

Sep. 2, 2004 (JP) ..... 2004-255834

(51) Int. Cl.
*B41J 2/01* (2006.01)

(52) U.S. Cl. ..... 347/104; 347/103; 347/101; 101/118

(58) Field of Classification Search ..... 347/103, 347/101, 104; 101/118
See application file for complete search history.

(56) References Cited

U.S. PATENT DOCUMENTS 6,375,319 B1 4/2002 Kamano et al.
6,465,154 B1 * 10/2002 Fromson et al. ..... 101/141

FOREIGN PATENT DOCUMENTS

| | | |
|---|---|---|
| JP | 53-57734 | 5/1978 |
| JP | 55-159659 | 11/1980 |
| JP | 63-209861 | 8/1988 |
| JP | 2-054292 | 2/1990 |
| JP | 2-147538 | 6/1990 |
| JP | 4-265782 | 9/1992 |
| JP | 2559043 | 9/1996 |
| JP | 10-175337 | 6/1998 |
| JP | 10-193719 | 7/1998 |
| JP | 2868723 | 12/1998 |
| JP | 2001-019217 | 1/2001 |

* cited by examiner

*Primary Examiner* — Manish S Shah
(74) *Attorney, Agent, or Firm* — Wenderoth, Lind & Ponack, LLP.

(57) ABSTRACT

An inkjet printing press is provided which can hold sheets extremely stably. In an inkjet printing press, an inkjet head 3 is provided at the outer periphery of a printing drum 1 rotated in one direction. The printing drum 1 is provided with holding claws 15 which are opened and closed to hold the leading end of the sheet S, and clamps 21 which can be opened and closed for clamping the trailing end of the sheet S. When the clamps 21 are moved from their open positions to their closed positions, the clamps 21 are moved backward with respect to the rotating direction of the printing drum 1 to impart a tensile force to the trailing end of the sheet S and tighten the sheet so that the trailing end of the sheet is held by a clamp 21 with the sheet in its tight state. Also, the clamp 21 is brought into contact with the periphery of the printing drum 1 by an attracting device to assure the holding of the sheet.

23 Claims, 7 Drawing Sheets

INKJET PRINTING PRESS

BACKGROUND OF THE INVENTION

1. Technical Field

This invention relates to an inkjet printing press for printing sheets with inkjets.

2. Background Art

Inkjet printing presses are known which have an inkjet head provided at the outer periphery of a rotary printing drum to jet ink against a sheet held on the peripheral surface of the printing drum for printing.

With such an inkjet printing press, the smaller the gap between the sheet and the inkjet head having a plurality of nozzles, the less the interference to ink dots jetted from the nozzles and thus the better the printing quality. But, if the gap is too small, the sheet might contact the inkjet head, thus causing smudges or accidents. Practically, the press is used with the inkjet head in proximity to the sheet to a limit where there is no trouble such as mechanical contact while the inkjet head and the sheet are moving relative to each other for printing. Because this gap is normally extremely small, if the sheet is not held properly on the peripheral surface of the printing drum, accurate printing is impossible and the sheet can contact the inkjet head, thus causing smudges on the print surface of the sheet.

Therefore, with such a press, it is necessary to hold the sheet stably on the printing drum so that the entire surface of the sheet is kept in close contact with the peripheral surface of the printing drum.

As means for holding the sheet, the following two are known. One involves attracting the sheet directly on the peripheral surface of the printing drum by static electricity or air suction, and the other involves holding the ends of the sheet by clamp strips or divided clamps.

With the method of holding a sheet by surface attraction such as by static electricity as disclosed in JP Patent 2868723, the sheet holding force is strong in the transverse direction but weak in the vertical direction. Thus, in printing a firm sheet, attraction at the sheet end tends to be insufficient, and if the sheet is thick, the sheet end tends to separate from the peripheral surface of the printing drum. Also, in order to hold a sheet being fed at high speed, large static electricity is required. This may cause electrical discharge with an inkjet press in which the inkjet head has to be provided in proximity to the printing drum.

Also, with the method of holding the sheet by negative pressure as disclosed in JP Patent 2868723, it is possible to attract the sheet onto the printing drum properly at a closed area such as at the center of the sheet, but at the peripheral portion of the sheet, because air is sucked from sheet ends, negative pressure cannot be maintained, so that sheet ends cannot be held effectively. Further, if the sheet is absorptive such as paper, negative pressure applied to the sheet may cause the ink applied by the inkjet head to permeate into the sheet. This results in change of ink color depending on the degree of permeation and makes it difficult to provide stable printing quality.

On the other hand, with the method of holding the sheet mechanically by clamps, the sheet ends are prevented from separating from the drum surface because the sheet is clamped at its ends. But there are the following problems.

That is, because ordinary clamps are of such a structure that they open and close radially of the printing drum, they cannot impart a tensile force to the sheet. Thus, the sheet tends to be loose and lift off the drum surface, so that it is not possible to obtain a stable mounting state in which the entire sheet is in close contact with the drum surface.

As a device which uses clamps to impart tension to the sheet, the device disclosed in Japanese patent publication 7-195780A is known. But because it imparts tension by dividing a portion of the rotary drum corresponding to the trailing end of the sheet so as to be movable, it is not suited for use with general-purpose presses which print sheets of different sizes at high speed.

Also, because the clamps holds the sheet while pulling both ends of the sheet extending axially toward the center of the drum, if the sheet is thick, the clamps tend to run obliquely on the sheet ends and warp on the sheet with the central portions of the clamps protruding radially outwardly from the drum surface. Thus, the clamps have to be rigid and thick. In this arrangement, it is difficult to assure a gap of proper size between the inkjet head and the peripheral surface of the printing drum.

Also, as disclosed in JP Patent 2559043, a sheet trailing end clamp has been put to practical use which is divided into a plurality of parts axially of the printing drum. But because it is adapted to clamp only part of the trailing end of the sheet, if the sheet supplied has a bent end, the clamp can not hold the sheet. Also, with this type of printing drum, the drum surface is divided circumferentially into rings, and the divided clamps are movably held between the rings, thereby holding sheets of different sizes. But in order to make smooth the drum surface on which divided sheets have to be held in a smooth state, a complicated mechanism requiring high accuracy is needed, and thus the device tends to be very expensive.

An object of the present invention is to provide an inkjet printing press which can hold sheets extremely stably on the peripheral surface of the printing drum and thus can print at high speed with high accuracy.

SUMMARY OF THE INVENTION

To solve the above problems, according to a first aspect of the present invention, the inkjet printing press includes a rotary printing drum and an inkjet head provided at an outer periphery of the printing drum and having nozzles through which ink is jetted against a sheet held on the peripheral surface of the printing drum for printing, characterized in that the printing drum is provided with a sheet holding mechanism for holding a leading end of the sheet on the printing drum, clamps which can be opened and closed for pressing a trailing end of the sheet against the peripheral surface of the printing drum, a clamp opening/closing mechanism for opening and closing the clamps, a position changing mechanism for adjusting the positions of the clamps in cooperation with the clamp opening/closing mechanism circumferentially of the printing drum according to the position of the trailing end of sheets having different lengths, and an attracting force producing means for producing a force for attracting the clamps together with the trailing end of the sheet to the peripheral surface of the printing drum.

Also, according to a second aspect of the present invention, each clamp is a thin plate strip extending axially of the printing drum and the thickness of the clamps is set so that the sum of the thickness of each clamp and the thickness of the sheet is smaller than a gap defined between the outer peripheral surface of the printing drum and the inkjet head. This assures that the sheet can be held without interfering with the inkjet head.

Also, according to a third aspect of the present invention, after the sheet holding mechanism has held a new sheet supplied to be held on the printing drum, in the step of holding the trailing end of the sheet by a clamp, when the clamp moves from its open position where it is off the peripheral surface of the printing drum to its closed position where it is on the trailing end of the sheet and the peripheral surface of the printing drum, the clamp moves first forward of the rotating direction of the printing drum and then backward. This assures that the frictional force acting on the contact surface between the clamp and the sheet imparts tensile force to the sheet and removes looseness of the sheet, thereby holding the sheet stably.

Also, according to a fourth aspect of the present invention, the sheet holding force of the sheet holding mechanism is set to be larger than the tensile force in a tangential direction of the periphery of the printing drum, imparted to the sheet when the clamp holds the sheet in the third aspect of the invention, and the frictional force by contact between the clamp and the sheet is set to be larger than the frictional force by contact between the sheet and the surface of the printing drum. This assures that while the clamp imparts tension to the sheet to remove looseness, the tip of the sheet will not get off the sheet holding mechanism.

In the inkjet printing press according to the first to third aspects of the invention, a plurality of sheet holding mechanisms are provided circumferentially of the printing drum at equal intervals and the clamps are each provided so as to correspond to one of the sheet holding mechanisms. This makes it possible to print a plurality of sheets simultaneously and improve the printing efficiency.

In the inkjet printing press according to the first and second aspects of the invention, as the attracting force producing means, an attracting body having a magnetic attracting force acting on the outer periphery of the printing drum is used, and the clamps may be formed of a magnetic material so as to be attracted by the attracting body. The attracting force producing means may comprise a multiplicity of suction holes formed in the outer periphery of the printing drum, and a suction head provided in the printing drum to apply suction force to the suction holes closed by the clamp to attract the clamp to the peripheral surface of the printing drum.

A rotatable hold-down roller may be provided at the outer periphery of the printing drum so as to be moved into and out of contact with the outer periphery of the printing drum and to press the sheet against the peripheral surface of the printing drum while the sheet is rotating together with the printing drum with its leading end held by the sheet holding mechanism. Because the sheet can be pressed against the outer periphery of the printing drum by the hold-down roller, the sheet can be brought into close contact with the printing drum more effectively.

According to the present invention, the clamps in their closed positions are adjusted according to the size of the sheet and hold the sheet with the trailing end of the sheet attracted to the surface of the printing drum by the attracting mechanism. Therefore, it is possible to hold the trailing end of the sheet securely independently of the size of the sheet and to adopt thin metal sheets having a low rigidity as the clamps. This makes it possible to set the gap between the inkjet head and the sheet to a very small value and thus makes high quality printing possible. Also, because the sheet holding force can be produced reliably even if the area for holding the trailing end of the sheet by a clamp is small, a wider area of the sheet to near its trailing end is usable for printing as the effective printing area.

Also, the attracting force at the peripheral surface of the printing drum acts on the clamp portion only and has little effect on the sheet itself. Therefore, good printing quality is assured independently of the size and material of the sheet.

Further, the clamp for holding the trailing end of the sheet is moved backward with respect to the rotating direction of the printing drum when it is moved from their open position to closed position, so that tension is imparted to the trailing end of the sheet by frictional force produced by contact with the clamp. Therefore the sheet can be held in a stable state with the entire sheet in close contact with the peripheral surface of the printing drum and thus extremely high quality printing is possible by inkjet.

DETAILED DESCRIPTION OF THE INVENTION

Figure 1:
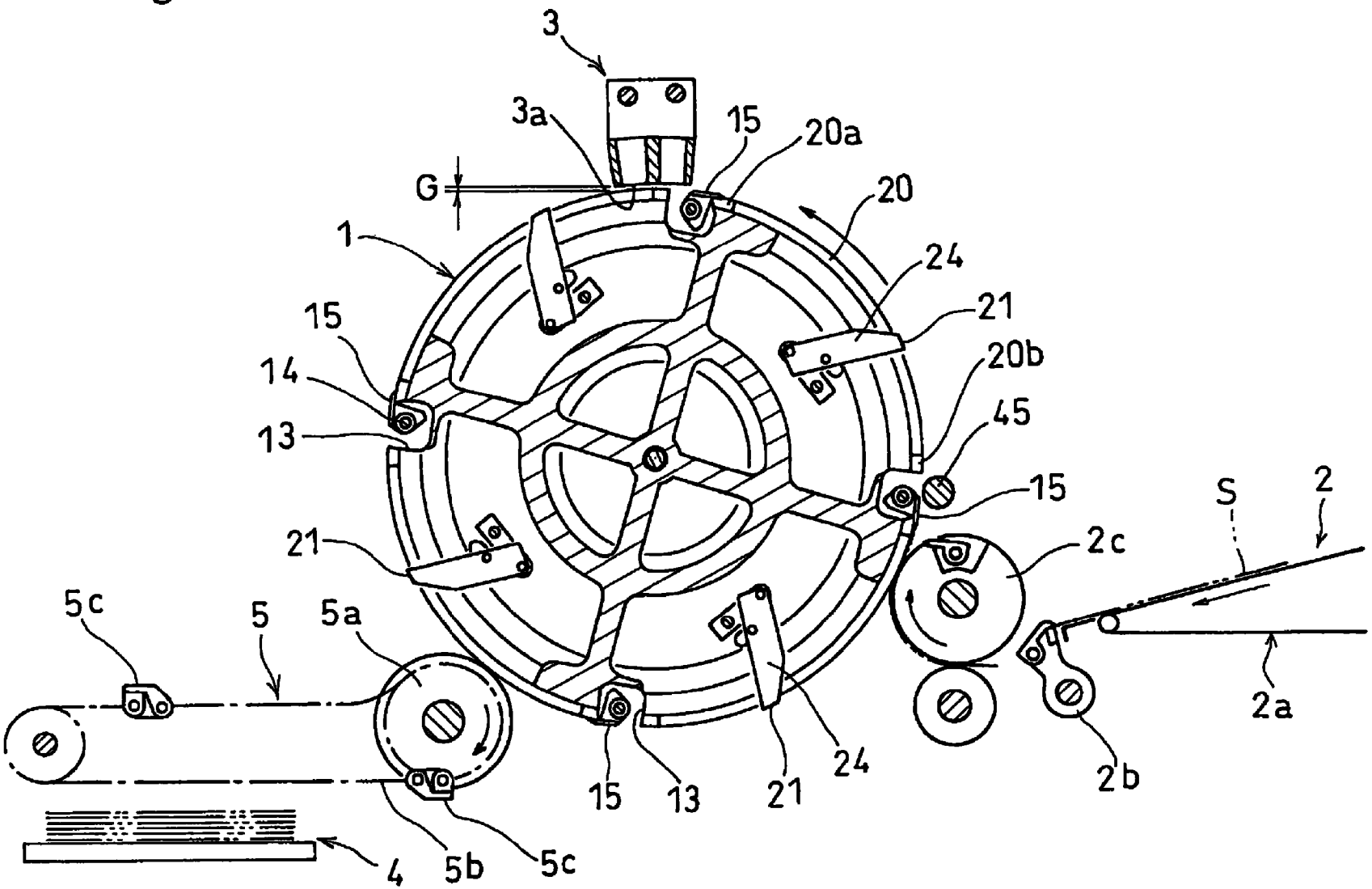
FIG. 1 is a partially cut away front view showing one embodiment of the printing press according to this invention.

Now an embodiment of this invention is described with reference to the drawings. As shown in FIG. 1, the printing press according to the present invention includes a rotary printing drum 1, a sheet feeder 2 for feeding sheets S to the printing drum 1, an inkjet head 3 facing the outer periphery of the printing drum 1 to jet ink to sheets S held on the periphery of the printing drum 1 and fed circumferentially for printing, and a sheet discharge unit 5 for receiving the printed sheets S from the printing drum 1 and feeding them to a sheet discharge station 4.

The sheet feeder 2 feeds sheets S one after another in one direction on a sheet conveyor 2*a*, grips the tip of the sheet S fed to the discharge end of the sheet conveyor 2*a* by a pivotal end of a swing gripper 2*b*, and pivots the swing gripper 2*b* toward a transfer cylinder 2*c* which is rotating in one direction to deliver the sheets S from the swing gripper 2*b* to holding claws provided on the transfer cylinder 2*c* and then deliver the sheets S from the transfer cylinder 2*c* to the printing drum 1.

The inkjet head 3 has a nozzle surface 3*a*. A gap G about 1 mm is present between the nozzle surface 3*a* and the outer periphery of the printing drum 1. The inkjet head 3 has a multiplicity of nozzles (not shown) in the nozzle surface 3*a* through which ink is jetted onto the periphery of the printing drum 1 to print the sheets S.

The sheet discharge unit 5 is a chain delivery comprising a sheet take-up cylinder 5*a*, a chain 5*b* trained around the cylinder 5*a*, and a plurality of gripper bars 5*c* mounted on the chain 5*b* at equal intervals. The printed sheets S are transferred from the printing drum 1 to the gripper bars 5*c*. By moving the chain 5*b*, the sheets S held by the gripper bars 5*c* are fed to the sheet discharge station 4, where the sheets are released.

Figure 2:
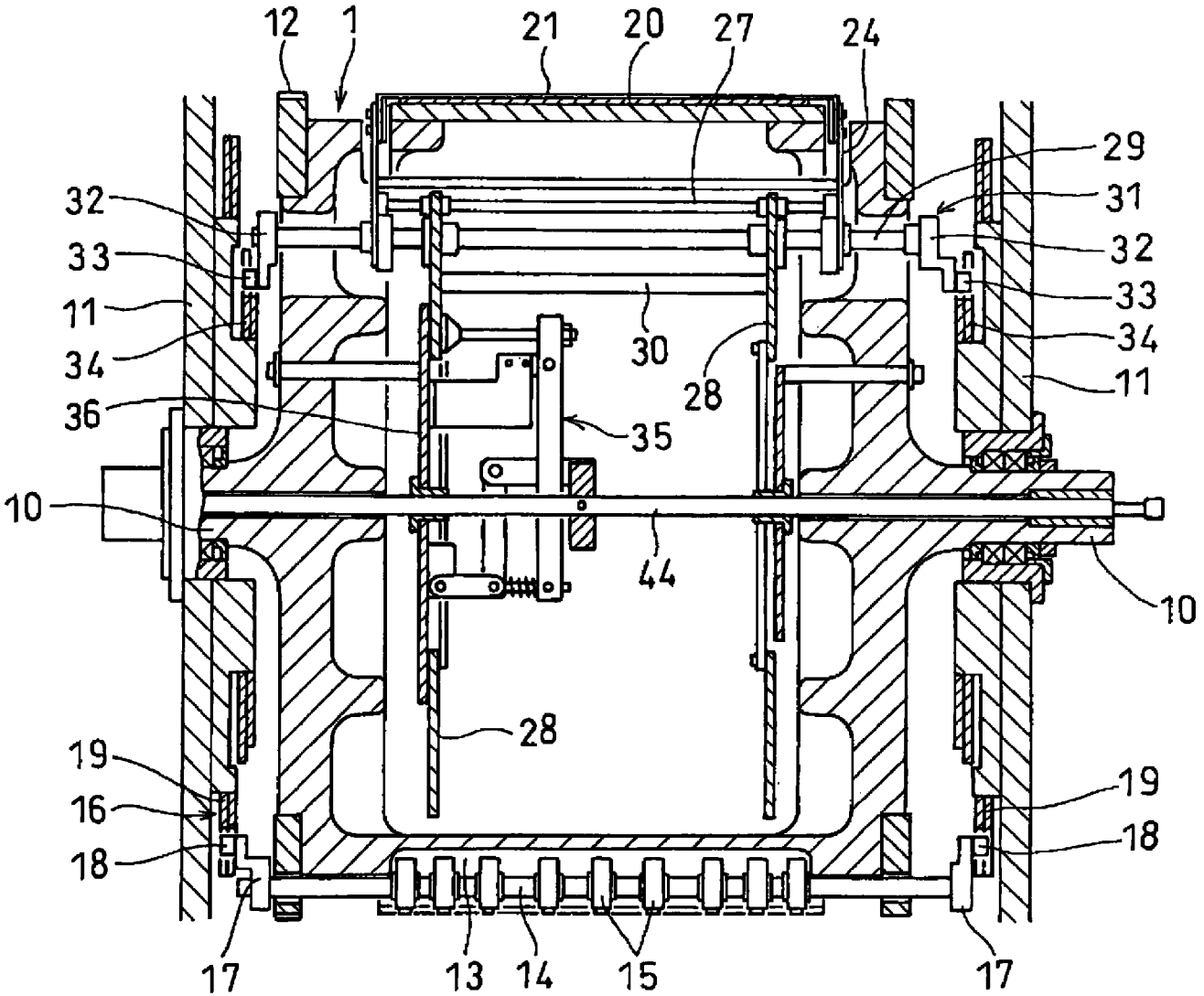
FIG. 2 is a vertical sectional side view of the printing drum shown in FIG. 1.
Figure 3:
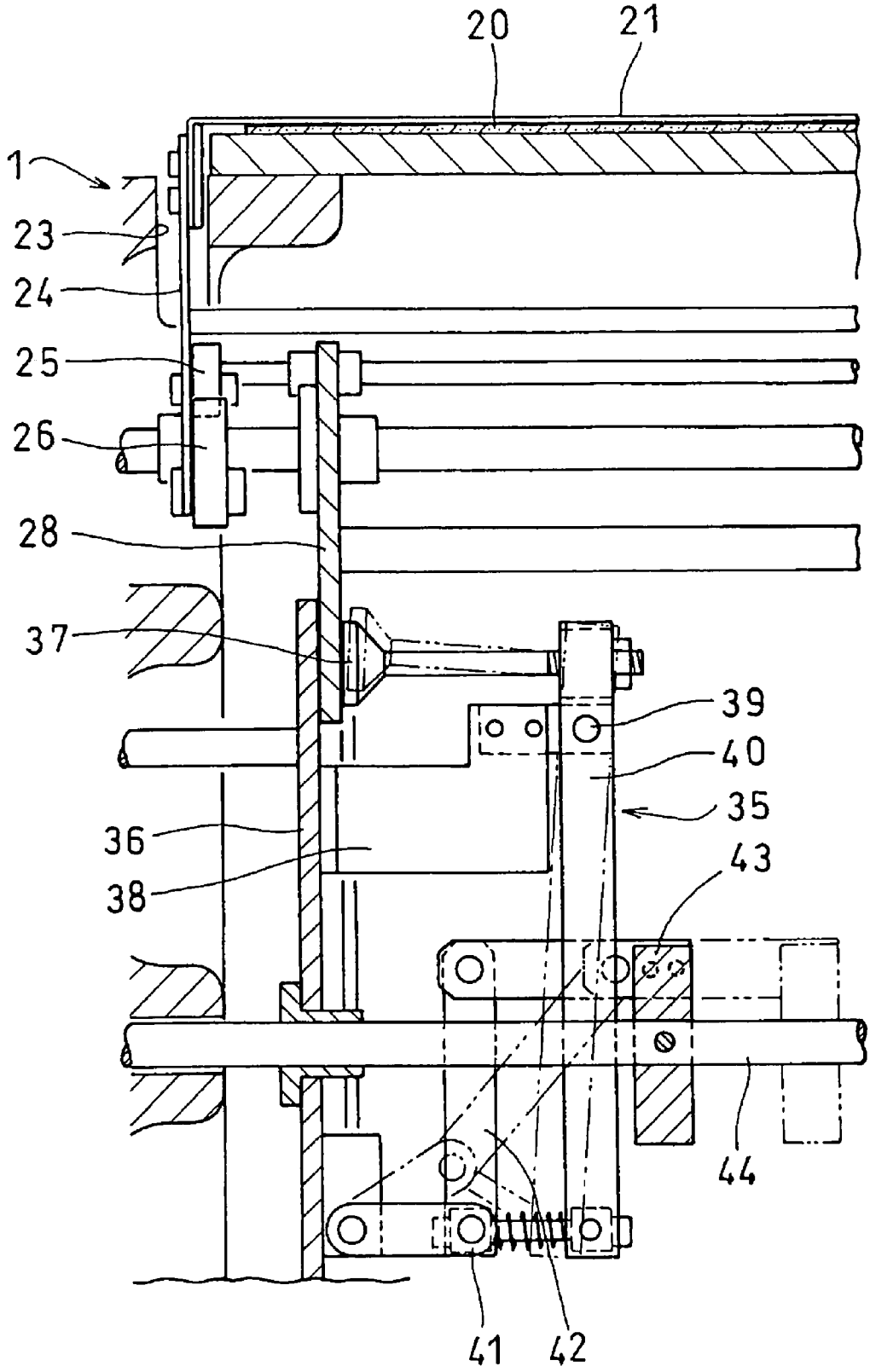
FIG. 3 is an enlarged sectional view of a portion of the printing drum.
Figure 4:
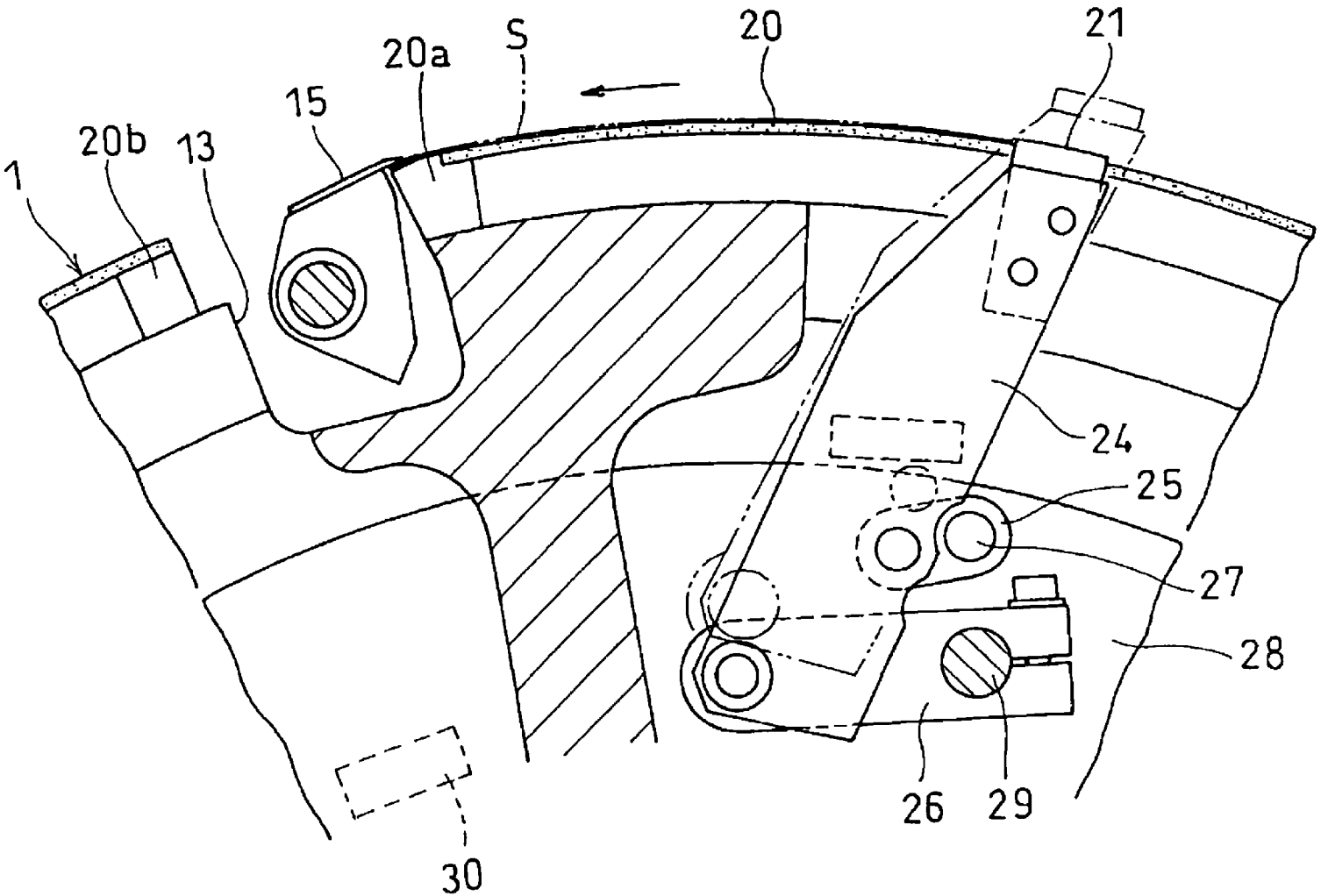
FIG. 4 is an enlarged vertical sectional front view of a portion of the printing drum.

FIGS. 2 to 4 show the printing drum 1. The drum 1 has drum shafts 10 at both ends which are rotatably supported by a pair of frames 11 of the printing press.

A gear 12 is mounted on one end of the printing drum 1. Driving torque is transmitted to the gear 12 to rotate the printing drum 1 in the direction of the arrows in FIGS. 1 and 4.

The printing drum 1 is formed in its outer periphery with a plurality of recesses 13 in the form of axial grooves arranged at equal circumferential intervals. A claw shaft 14 is received in each recess 13.

The claw shafts 14 are rotatably supported on end walls of the recesses 13. A plurality of holding claws 15 are mounted on the portion of each claw shaft 14 that is located in the recess 13. Although the holding claws are used to hold sheets, any other means using negative pressure, static electricity, etc. may be used instead, provided it can hold the tips of the sheets properly.

As shown in FIG. 2, the holding claws 15 are opened and closed by a cam mechanism 16 as an opening/closing mechanism. The cam mechanism 16 has roller arms 17 each mounted at one end thereof on one end of each claw shaft 14 and rotatably carrying a roller 18 at the other end. The rollers 18 are kept in elastic contact with the outer surfaces of claw opening/closing cams 19 each mounted on the inner wall of one of the frames 11 through springs (not shown). As the printing drum 1 rotates, the rollers 18 roll along the outer surfaces of the claw opening/closing cams 19 to open and close the holding claws 15. The claw opening/closing cams 19 on both sides work as conjugate cams. Although a cam mechanism is used as the clamp opening/closing mechanism, any other mechanism using a motor or solenoids may be used instead.

The holding claws 15 are normally held in closed positions. When it is necessary to feed a sheet S while the printing drum 1 is rotating, the holding claws 15 are opened and closed by the claw opening/closing cams 19 at a position where they are opposite to the transfer cylinder 2*c*, so that the sheet S is transferred from the transfer cylinder 2*c* when the holding claws 15 turn from their open states to their closed states. Also, when it is necessary to discharge a sheet S held on the printing drum 1, the holding claws 15 are opened by the claw opening/closing cams 19 at a position where they are opposed to the sheet take-up cylinder 5*a*. When the claws 15 turn from their closed states to their open states, the sheet S is transferred to one of the gripper bars 5*c* of the sheet discharge unit 5.

As shown in FIGS. 1 and 4, the peripheral surfaces of the printing drum 1 between the adjacent recesses 13 are formed by attracting bodies 20 which are sheets of magnetic rubber (rubber magnet) having a thickness of 3.2 mm and having a magnetic attracting force. The leading edge of each attracting body 20 with respect to the rotating direction of the printing drum 1 is fixed to an anvil 20*a* and its trailing edge is fixed to a bar 20*b*, both by an adhesive, and the anvil 20*a* and the bar 20*b* are removably fixed to the printing drum 1 so that the attracting bodies 20 can be replaced. The attracting bodies 20 have their surfaces finished by grinding into flat surfaces and are held in close contact with the printing drum 1, which is finished by grinding to a cylindrical shape, so that the gap between the printing drum 1 and the inkjet head 3 can be kept accurately. The accuracy of the gap can also be assured by finishing the printing drum by grinding after mounting the attracting bodies 20, which are sheets of magnetic rubber, on the surface of the printing drum 1 into close contact therewith. Further, instead of using attracting bodies as separate parts, the printing drum 1 itself may be formed of a magnetic material.

As the magnetic rubber, it is necessary to use a rubber substrate having corrosion resistance to the ink used or to subject the surface of the rubber to coating to impart corrosion resistance.

Over each attracting body 20, a clamp 21 is provided to press the trailing end of a sheet S against the outer periphery of the attracting body 20 with the tip of the sheet S held by the holding claws 15.

The clamps 21 are stainless steel sheets SUS304CSP made of a magnetic material and having a thickness of 0.2 mm and a width of 20 mm so as to be attracted by the attracting bodies 20. The thinner the clamps 21, the more easily they can be bent along the periphery of the printing drum 1, so that sheets S can be pressed more reliably. On the other hand, the thicker the clamps 21, the larger the attracting force by magnetic force. Therefore, stainless steel sheets having a thickness of 0.05 to 0.5 mm, preferably 0.1 to 0.3 mm are used as the clamps 21. As the material for the clamps, stainless steel alloy is excellent in view of magnetic force, strength and corrosion resistance, but spring steel having strong magnetism may be used according to the intended use.

As shown in FIG. 3, the clamps 21 extend axially of the printing drum 1 as elongated one-piece parts and have their ends bent at a right angle inwardly into a □-shape. Their bent portions are inserted into slots 23 formed at both ends of the outer periphery of the printing drum 1 and tips of clamp arms 24 are coupled to the bent portions.

As shown in FIGS. 3 and 4, one end of a short link 25 is coupled to each clamp arm 24 at a position near its trailing end and one end of a long link 26, too, is coupled to the clamp arm 24 at a position nearer to its trailing end than the one end of the short link 25. The other end of the short link 25 is supported on a first shaft 27, which is rotatably supported by two annular plates 28 provided in the printing drum 1, so that the short link 25 can pivot about the first shaft 27.

On the other hand, the other end of the long link 26 is supported by a second shaft 29, which is rotatably supported on the annular plates 28, so that the long link 26 can pivot about the second shaft 29.

The two annular plates 28 are coupled together by a plurality of stays 30 extending between the annular plates 28 and are supported so as to be slidable and rotatable about a control shaft 44 coaxial with the axis of the printing drum 1. Thus, by turning the annular plates 28, the positions of the plurality of clamps 21 are adjusted simultaneously in the circumferential direction.

Because the positions of the clamps 21 are adjustable in the circumferential direction of the printing drum 1 as described above, it is possible to clamp the trailing ends of sheets S of different sizes.

The clamps 21 are opened and closed by a cam mechanism 31 shown in FIG. 2. The cam mechanism 31 includes roller arms 32 each having one end thereof mounted on one of the ends of the second shaft 29, which protrude from the sides of the printing drum 1, and rotatable rollers 33 carried on the other ends of the roller arms 32 and kept in elastic contact with the outer surfaces of clamp opening/closing cams 34 each mounted on the inner wall of one of the frames 11 through springs (not shown). Thus, as the printing drum 1 rotates, the rollers 33 roll along the outer peripheries of the clamp opening/closing cams 34 to open and close the clamps 21. The clamp opening/closing cams 34, which are provided on both sides, work as conjugate cams.

Figure 5:
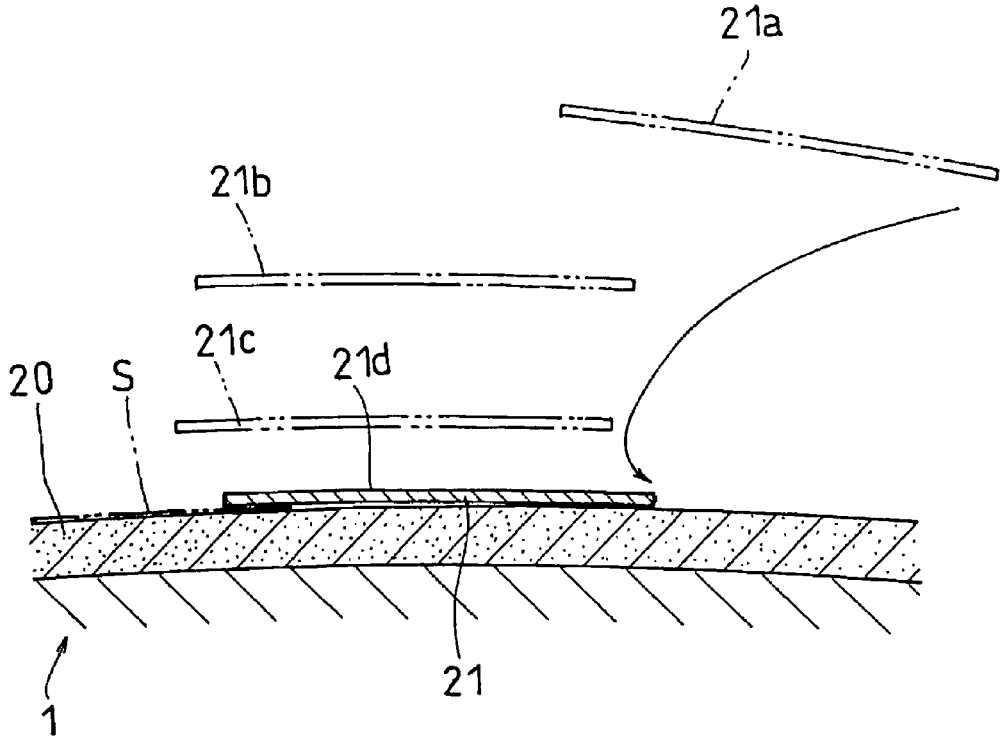
FIG. 5 is a sectional view of a clamp.

As described above, the short link 25 coupled with each clamp arm 24 is pivotable about the first shaft 27 whereas the long link 26 is pivotable about the second shaft 29. Therefore, when the clamp 21 in its open position moves to its closed position, where it abuts against the peripheral surface of the magnetic rubber sheet 20, it moves first forward in the rotating direction of the printing drum 1 and then backward into its closed position as shown in FIG. 5 by an arrow.

The position of each clamp 21 is adjusted beforehand according to the size of the sheet S so that it rests on the trailing end of the sheet S and the surface of the attracting body 20 in its closed position.

The annular plates 28, which serve to adjust the circumferential positions of the clamps 21, are locked relative to the printing drum 1 by a lock mechanism 35 shown in FIG. 3.

The lock mechanism 35 includes a braking plate 36 provided outside of one of the annular plates 28 so as to rotate together with the printing drum 1 and a pad 37 provided on the other side of the annular plate 28 so as to move toward the annular plate 28 to press the annular plate 28 against the braking plate 36.

In this embodiment, as a means for moving the pad 37 toward the annular plate 28, a lever 40 is pivotally supported on a support 38 fixed to the braking plate 36 through a pin 39; the pad 37 is mounted on one end of the lever 40; the other end of the lever 40 is coupled with the braking plate 36 through a two-joint link 41; one end of a link 42 is coupled to the bent portion of the two-joint link 41; and an L-shaped arm 43 coupled to the other end of the link 42 is mounted on the control shaft 44, which is arranged on the axis of the printing drum 1. By axially moving the control shaft 44, the pad 37 is moved relative to the annular plate 28.

As shown in FIG. 1, a hold-down roller 45 is provided over the transfer cylinder 2*c* of the sheet feeder 2. The hold-down roller 45 is movable into and out of contact with the outer periphery of the printing drum 1. When in contact, it serves to press the sheet S against the peripheral surface of the printing drum 1 while the sheet is being fed circumferentially with its leading end held by holding claws 15.

The printing press of this embodiment is of the structure described above. When a sheet S is fed onto the printing drum 1 by the sheet feeder 2, it is fed circumferentially by the rotation of the printing drum 1 with its leading end clamped by holding claws 15.

At this time, the hold-down roller 45 is arranged in a position where it is put into contact with the printing drum 1. Thus, the sheet S fed in a circumferential direction of the printing drum 1 is pressed by the hold-down roller 45 against the peripheral surface of the printing drum 1 into close contact therewith.

When the entire area of the sheet S is on the periphery of the printing drum 1, the cam mechanism 31 for opening and closing the clamps 21 moves one of the clamps to closed position, so that the clamp abuts the peripheral surface of the printing drum 1.

At this time, because the short link 25 and the long link 26 pivot to move the clamp 21 first forward in the rotating direction of the printing drum 1 and then backward into its closed position, a pulling force is imparted to the trailing end of the sheet S by contact with the clamp 21.

Now the relative position between the sheet S and the clamp 21 when feeding the sheet is described. Just before the clamp 21 begins to hold the sheet S, the clamp 21 is in the position 21*a* in FIG. 5, where it does not interfere with the trailing end of the sheet S. Next, in the position 21*b*, the clamp 21 moves radially inwardly toward the sheet S to hold down its trailing end. In the position 21*c*, the central portion of the clamp 21 is attracted by the magnetic rubber 20 and bent until a portion of the clamp 21 contacts the magnetic rubber 20 with the sheet S between them. While pressing the trailing end of the sheet S partially, the clamp 21 moves backward with respect to the rotating direction of the printing drum 1 and radially inwardly. In the position 21*d*, the entire surface of the clamp 21 is attracted by the magnetic rubber 20 with the sheet S between them. In this state, the relation K>M>D is met, where K is the sheet holding force by the holding claws 15; M is the sliding frictional force between the clamp 21 and the sheet S; D is the sliding frictional force between the sheet S and the surface of the printing drum 1 (attracting body 20). When the clamp 21 moves backward while maintaining contact with the sheet S, tensile force is applied to the sheet S backward with respect to the rotating direction of the printing drum 1. With this series of actions, it is possible to reliably bring the sheet S into close contact with the surface of the printing drum without looseness to the trailing end while holding the sheet S stably by the holding claws 15. Also, such a clamp mechanism is effective to prevent the sheet from getting marred or smeared even if used with a transfer cylinder of an offset press or more complicated apparatus using a rotary drum.

Because by keeping the clamp 21 closed, the sheet S can be securely held in a stable state with its entire surface in close contact with the printing drum 1, the gap between the inkjet head 3 and the sheet S can be set properly, thereby assuring highly accurate printing. Also, because the sheet holding size necessary for holding the sheet S by the clamp 21 can be shortened, it is possible to use a wider area for printing nearer to the trailing end of the sheet than before. Particularly, if the sheet holding size is three to 200 times the thickness of the sheet, preferably 20 to 100 times, it is possible to hold the sheet stably and provide a wide effective printing range.

When printing of the sheet S is complete, the sheet S is transferred from the printing drum 1 to the sheet discharge unit 5. In this state, the holding claws 15 of the printing drum 1 open and one of the gripper bars 5*c* holds the tip of the sheet S. When the printing drum 1 turns to a position where the trailing end of the sheet S leaves the periphery of the printing drum 1, the cams 34 of the cam mechanism 31 set beforehand in a position for opening the clamp 21 operate to open the clamp and release the trailing end of the sheet S. At this time, because the clamp releasing force of the cam mechanism 31 is set to be larger than the attracting force of the attracting body 20 acting on the clamp 21, the clamp can be released extremely easily without the need of adopting a complicated arrangement using an electromagnet as an attracting body to turn the attracting force on and off.

The printed sheet S is fed by the sheet discharge unit 5 to the sheet discharge station 4 and discharged.

When the size of the sheet S to be printed changes, the positions of the clamps 21 have to be adjusted according to the size of the sheet S.

In adjusting the positions of the clamps 21, all the clamps are moved to their open positions by means of the cams (not shown) provided for opening and closing the clamps, and pins (not shown) are pushed into the frames 11 to fix the phase of the annular plates 28 relative to the frames 11. Then, the lock mechanism 35 shown in FIG. 3 is operated to unlock the annular plates 28. By imparting a driving force to the gear 12, the printing drum 1 is turned by a required amount according to the size of the sheet S to be printed. Since the plurality of clamps 21 are supported by the annular plates 28, the position of the plurality of clamps can be adjusted simultaneously.

After adjusting the positions of the clamps 21, the lock mechanism 35 is operated to lock the annular plates 28, and the pins are removed from the frames 11 to unlock the annular plates 28.

In the embodiment shown in FIG. 5, magnetic attracting bodies are mounted on the periphery of the printing drum 1 to attract the clamps 21. But, means for attracting the clamps 21 is not limited thereto.

Figure 6:
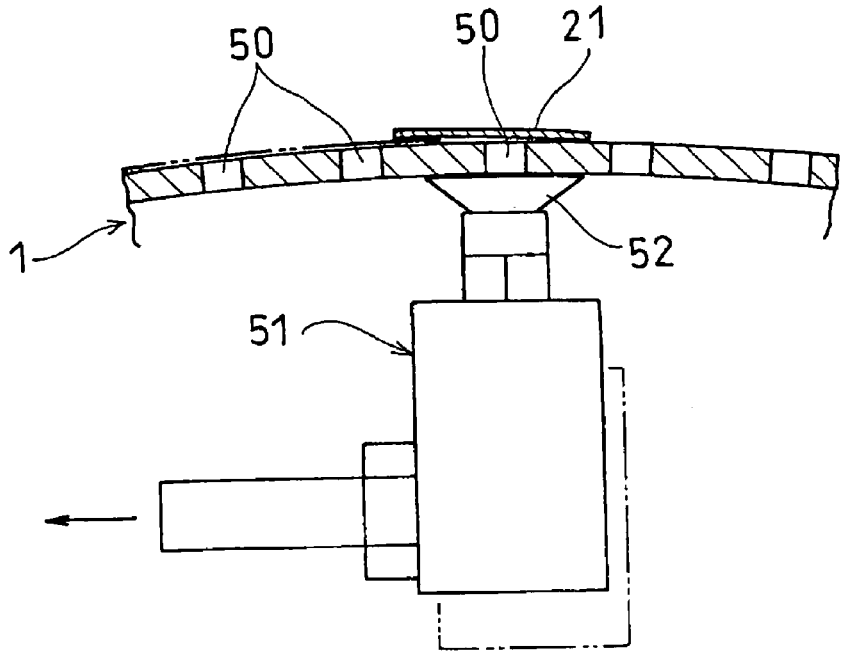
FIG. 6 is a vertical sectional front view of another embodiment of an attracting means.
Figure 7:
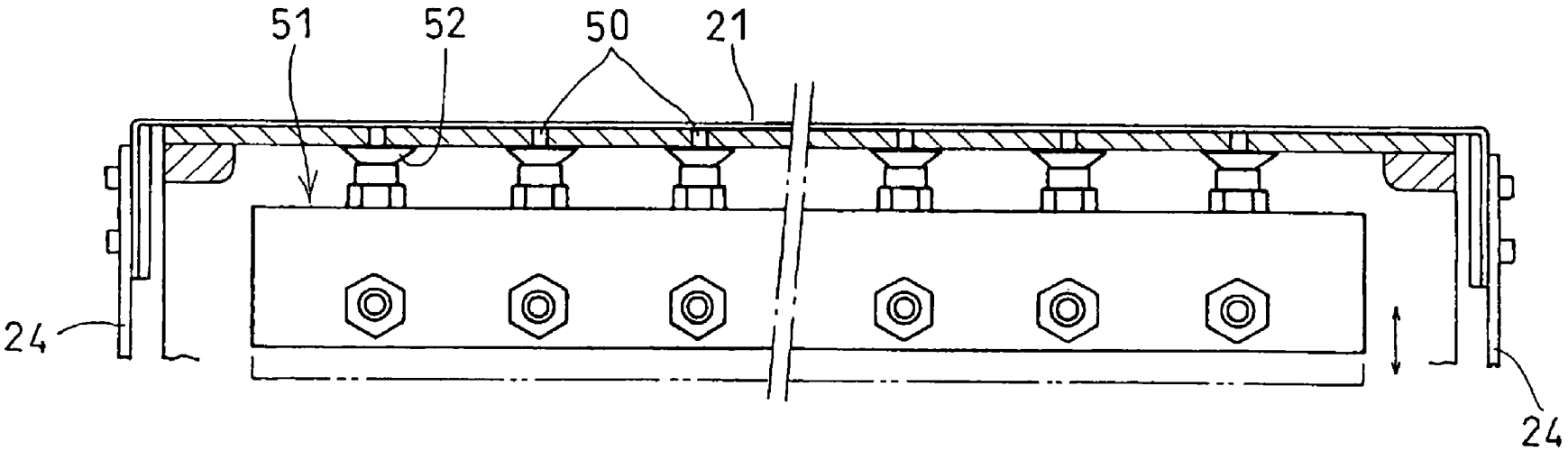
FIG. 7 is a vertical sectional side view of FIG. 6.

For example, as shown in FIGS. 6 and 7, a plurality of suction holes 50 arranged axially at equal intervals may be formed in the peripheral wall of the printing drum 1 in rows and suction heads 51 may be provided in the printing drum 1 to apply a suction force to the suction holes 50 adapted to be closed by the clamps 21 when the clamps 21 are closed.

With such a suction means, the suction heads 51 and the clamps 21 should be arranged to allow circumferential position adjustment at the same phase to adapt to sheets S of different sizes.

Figure 8:
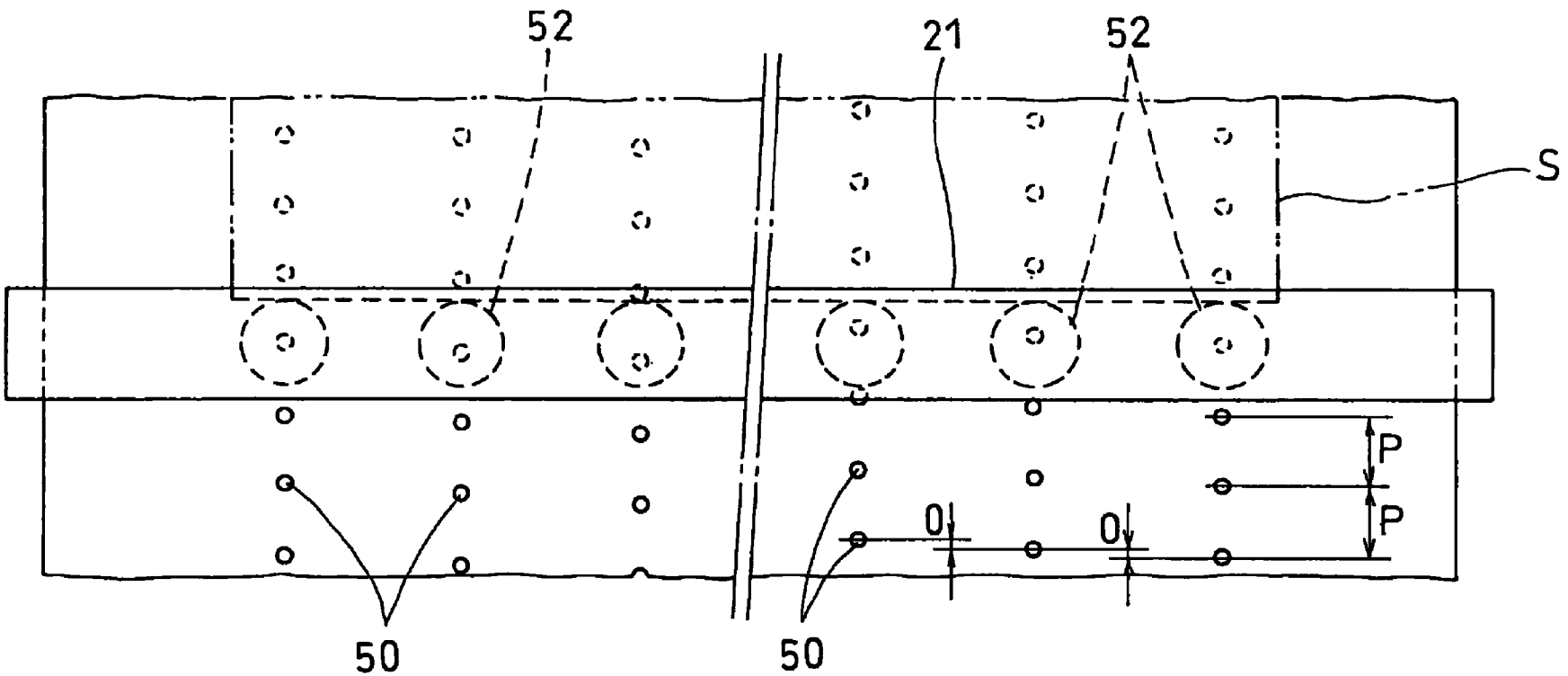
FIG. 8 is a plan view of the embodiment of FIG. 6.

FIG. 8 shows one example of the positional relationship among the clamp 21 and the suction holes 50 and suckers 52 as viewed from over the printing drum 1. The printing drum 1 is formed with the suction holes 50 of 3 mm diameter arranged at a circumferential pitch P of 10 mm in 11 rows and the suction holes 50 in adjacent rows are offset circumferentially by a distance 0 of 1 mm. The suction heads 51 are arranged in the printing drum 1 just under the respective clamps 21, which have a width of 20 mm, so as to be movable at the same phase as the clamps 21 and the suckers 52 have an effective suction diameter of 15 mm and are arranged at the same axial intervals as the suction holes 50. With this arrangement, in whatever phase the clamps 21 may be, suction force can be applied to at least one row of the suction holes 50 under the clamps 21, so that the clamps can be attracted reliably. Thus, it is possible to adapt to sheets S of different sizes.

Also, although in the embodiment shown in FIGS. 1 to 5, the clamps 21 are moved backward with respect to the rotating direction of the printing drum 1 to pull the trailing end of the sheet S with its leading end held by holding claws 15, the clamps 21 may be arranged to be opened and closed radially of the printing drum 1 because the sheet S can be put into close contact with the periphery of the printing drum 1 by means of the hold-down roller 45.

The invention claimed is:

1. An inkjet printing press including a rotary printing drum and an inkjet head provided at an outer periphery of said printing drum and having nozzles through which ink is jetted against a sheet held on the peripheral surface of said printing drum for printing, wherein said printing drum is provided with a sheet holding mechanism for holding a leading end of the sheet on said printing drum, clamps which can be opened and closed for pressing a trailing end of the sheet against the peripheral surface of said printing drum, a clamp opening/closing mechanism for opening and closing said clamps, a position changing mechanism for adjusting the positions of said clamps in cooperation with said clamp opening/closing mechanism circumferentially of said printing drum according to the position of the trailing end of sheets having different lengths, and an attracting force producer for producing a force for attracting said clamps together with the trailing end of the sheet to the peripheral surface of said printing drum, wherein assuming that K is the sheet holding force of said sheet holding mechanism, M is the sliding frictional force between said clamp and the sheet, and D is the sliding frictional force between the sheet and the surface of said printing drum, the relation K>M>D is met.

2. The inkjet printing press of claim 1 wherein said clamps are thin plate strips extending axially of said printing drum, and the sum of the thickness of said clamps and the thickness of the sheet is set to be smaller than a gap defined between the outer peripheral surface of said printing drum and said inkjet head.

3. The inkjet printing press of claim 2 wherein when said each clamp moves from its open position where it is off the peripheral surface of said printing drum to its closed position where it is on the trailing end of the sheet and the peripheral surface of said printing drum, said each clamp moves first forward of the rotating direction of said printing drum and then backward.

4. The inkjet printing press of claim 1 wherein a plurality of said sheet holding mechanisms are provided circumferentially of said printing drum at equal intervals and said clamps are each provided so as to correspond to one of said sheet holding mechanisms.

5. The inkjet printing press of claim 4 wherein said attracting force producer is an attracting body having a magnetic attracting force acting on the outer periphery of said printing drum, said clamps being formed of a magnetic material so as to be attracted by said attracting body.

6. The inkjet printing press of claim 5 wherein a rotatable hold-down roller is provided at an outer periphery of said printing drum so as to be moved into and out of contact with the outer periphery of said printing drum and to press the sheet against the peripheral surface of said printing drum while the sheet is rotating together with said printing drum with its leading end held by said sheet holding mechanism.

7. The inkjet printing press of any of claim 6 wherein the clamp releasing force of said clamp opening/closing mechanism is set to be larger than the clamp attracting force produced by said attracting force producer.

8. The inkjet printing press of claim 5 wherein the clamp releasing force of said clamp opening/closing mechanism is set to be larger than the clamp attracting force produced by said attracting force producer.

9. The inkjet printing press of claim 5 wherein said attracting body is a magnetic rubber sheet which is deformable along the outer periphery of said printing drum.

10. The inkjet printing press of claim 4 wherein said attracting force producer comprises a multiplicity of suction holes formed in the outer periphery of said printing drum, and suction heads provided in said printing drum to apply suction force to said suction holes closed by said clamps to attract said clamps to the peripheral surface of said printing drum.

11. The inkjet printing press of claim 10 wherein a rotatable hold-down roller is provided at an outer periphery of said printing drum so as to be moved into and out of contact with the outer periphery of said printing drum and to press the sheet against the peripheral surface of said printing drum while the sheet is rotating together with said printing drum with its leading end held by said sheet holding mechanism.

12. The inkjet printing press of any of claim 11 wherein the clamp releasing force of said clamp opening/closing mechanism is set to be larger than the clamp attracting force produced by said attracting force producer.

13. The inkjet printing press of claim 10 wherein the clamp releasing force of said clamp opening/closing mechanism is set to be larger than the clamp attracting force produced by said attracting force producer.

14. The inkjet printing press of claim 4 wherein said clamps are thin plate strips extending axially of said printing drum, and the sum of the thickness of said clamps and the thickness of the sheet is set to be smaller than a gap defined between the outer peripheral surface of said printing drum and said inkjet head.

15. The inkjet printing press of claim 14 wherein when said each clamp moves from its open position where it is off the peripheral surface of said printing drum to its closed position where it is on the trailing end of the sheet and the peripheral surface of said printing drum, said each clamp moves first forward of the rotating direction of said printing drum and then backward.

16. An inkjet printing press including a rotary printing drum and an inkjet head provided at an outer periphery of said printing drum and having nozzles through which ink is jetted against a sheet held on the peripheral surface of said printing drum for printing, wherein said printing drum is provided with a sheet holding mechanism for holding a leading end of the sheet on said printing drum, clamps which can be opened and closed for pressing a trailing end of the sheet against the peripheral surface of said printing drum, a clamp opening/closing mechanism for opening and closing said clamps, a position changing mechanism for adjusting the positions of said clamps in cooperation with said clamp opening/closing mechanism circumferentially of said printing drum according to the position of the trailing end of sheets having different lengths, and an attracting force producer for producing a force for attracting said clamps together with the trailing end of the sheet to the peripheral surface of said printing drum, wherein said attracting force producer is an attracting body having a magnetic attracting force acting on the outer periphery of said printing drum, said clamps being formed of a magnetic material so as to be attracted by said attracting body, and wherein said attracting body is a magnetic rubber sheet which is deformable along the outer periphery of said printing drum.

17. An inkjet printing press including a rotary printing drum and an inkjet head provided at an outer periphery of said printing drum and having nozzles through which ink is jetted against a sheet held on the peripheral surface of said printing drum for printing, wherein said printing drum is provided with a sheet holding mechanism for holding a leading end of the sheet on said printing drum, clamps which can be opened and closed for pressing a trailing end of the sheet against the peripheral surface of said printing drum, a clamp opening/closing mechanism for opening and closing said clamps, a position changing mechanism for adjusting the positions of said clamps in cooperation with said clamp opening/closing mechanism circumferentially of said printing drum according to the position of the trailing end of sheets having different lengths, and an attracting force producer for producing a force for attracting said clamps together with the trailing end of the sheet to the peripheral surface of said printing drum, and wherein said attracting force producer comprises a multiplicity of suction holes formed in the outer periphery of said printing drum, and suction heads provided in said printing drum to apply suction force to said suction holes closed by said clamps to attract said clamps to the peripheral surface of said printing drum.

18. The inkjet printing press of claim 17 wherein a rotatable hold-down roller is provided at an outer periphery of said printing drum so as to be moved into and out of contact with the outer periphery of said printing drum and to press the sheet against the peripheral surface of said printing drum while the sheet is rotating together with said printing drum with its leading end held by said sheet holding mechanism.

19. The inkjet printing press of any of claim 18 wherein the clamp releasing force of said clamp opening/closing mechanism is set to be larger than the clamp attracting force produced by said attracting force producer.

20. The inkjet printing press of claim 17 wherein the clamp releasing force of said clamp opening/closing mechanism is set to be larger than the clamp attracting force produced by said attracting force producer.

21. An inkjet printing press including a rotary printing drum and an inkjet head provided at an outer periphery of said printing drum and having nozzles through which ink is jetted against a sheet held on the peripheral surface of said printing drum for printing, wherein said printing drum is provided with a sheet holding mechanism for holding a leading end of the sheet on said printing drum, clamps which can be opened and closed for pressing a trailing end of the sheet against the peripheral surface of said printing drum, a clamp opening/closing mechanism for opening and closing said clamps, a position changing mechanism for adjusting the positions of said clamps in cooperation with said clamp opening/closing mechanism circumferentially of said printing drum according to the position of the trailing end of sheets having different lengths, and an attracting force producer for producing a force for attracting said clamps together with the trailing end of the sheet to the peripheral surface of said printing drum, wherein said attracting force producer is an attracting body having a magnetic attracting force acting on the outer periphery of said printing drum, said clamps being formed of a magnetic material so as to be attracted by said attracting body, and wherein a rotatable hold-down roller is provided at an outer periphery of said printing drum so as to be moved into and out of contact with the outer periphery of said printing drum and to press the sheet against the peripheral surface of said printing drum while the sheet is rotating together with said printing drum with its leading end held by said sheet holding mechanism.

22. The inkjet printing press of claim 21 wherein the clamp releasing force of said clamp opening/closing mechanism is set to be larger than the clamp attracting force produced by said attracting force producer.

23. An inkjet printing press including a rotary printing drum and an inkjet head provided at an outer periphery of said printing drum and having nozzles through which ink is jetted against a sheet held on the peripheral surface of said printing drum for printing, wherein said printing drum is provided with a sheet holding mechanism for holding a leading end of the sheet on said printing drum, clamps which can be opened and closed for pressing a trailing end of the sheet against the peripheral surface of said printing drum, a clamp opening/closing mechanism for opening and closing said clamps, a position changing mechanism for adjusting the positions of said clamps in cooperation with said clamp opening/closing mechanism circumferentially of said printing drum according to the position of the trailing end of sheets having different lengths, and an attracting force producer for producing a force for attracting said clamps together with the trailing end of the sheet to the peripheral surface of said printing drum, wherein said attracting force producer is an attracting body having a magnetic attracting force acting on the outer periphery of said printing drum, said clamps being formed of a magnetic material so as to be attracted by said attracting body, and wherein the clamp releasing force of said clamp opening/closing mechanism is set to be larger than the clamp attracting force produced by said attracting force producer.

* * * * *